US012449178B2

(12) United States Patent
Yao et al.

(10) Patent No.: US 12,449,178 B2
(45) Date of Patent: Oct. 21, 2025

(54) REFRIGERATOR

(71) Applicant: HISENSE RONSHEN (GUANGDONG) REFRIGERATOR CO., LTD., Guangdong (CN)

(72) Inventors: Huimin Yao, Guangdong (CN); Jinchao Xu, Guangdong (CN); Peng Li, Guangdong (CN)

(73) Assignee: HISENSE RONSHEN (GUANGDONG) REFRIGERATOR CO., LTD., Foshan (CN)

( * ) Notice: Subject to any disclaimer, the term of this patent is extended or adjusted under 35 U.S.C. 154(b) by 204 days.

(21) Appl. No.: 18/137,772

(22) Filed: Apr. 21, 2023

(65) Prior Publication Data

US 2023/0258382 A1 Aug. 17, 2023

Related U.S. Application Data

(63) Continuation of application No. PCT/CN2021/130756, filed on Nov. 15, 2021.

(30) Foreign Application Priority Data

May 28, 2021 (CN) ..... 202110598609.3

(51) Int. Cl.
*F25C 5/06* (2006.01)
*F25C 1/04* (2018.01)
*F25C 1/22* (2018.01)

(52) U.S. Cl.
CPC ..... *F25C 5/06* (2013.01); *F25C 1/04* (2013.01); *F25C 1/22* (2013.01)

(58) Field of Classification Search
CPC ..... F25C 1/04; F25C 5/06
See application file for complete search history.

(56) References Cited

U.S. PATENT DOCUMENTS 3,430,452 A 3/1969 Dedricks et al.
4,489,567 A 12/1984 Kohl
(Continued)

FOREIGN PATENT DOCUMENTS

CN 101886863 A 11/2010
CN 102135355 A 7/2011
(Continued)

OTHER PUBLICATIONS

Chinese Notification of the First Office Action dated Oct. 9, 2023 in corresponding Chinese Application No. 202110598794.6, translated, 16 pages.
(Continued)

*Primary Examiner* — Christopher R Zerphey
(74) *Attorney, Agent, or Firm* — MH2 TECHNOLOGY LAW GROUP LLP

(57) ABSTRACT

A refrigerator includes an ice maker. The ice maker includes a mold shell, a driving mechanism, a first push rod, a second push rod, and a connecting rod assembly. One of the first sub-mold shell and the second sub-mold shell is fixed, and another one is movable. The driving mechanism is configured to drive the first sub-mold shell or the second sub-mold shell to switch between a separated state and a closed state. One of the first push rod and the second push rod is fixed, and another one is movable. The connecting rod assembly includes a connecting rod. An end of the connecting rod is connected to the movable one of the first sub-mold shell and the second sub-mold shell, and another end of the connecting rod is connected to the movable one of the first push rod and the second push rod.

15 Claims, 12 Drawing Sheets

(56) References Cited

U.S. PATENT DOCUMENTS

| | | | | |
|---|---|---|---|---|
| 9,234,688 | B2 * | 1/2016 | Son | F25C 5/06 |
| 9,234,689 | B2 * | 1/2016 | Son | F25C 1/10 |
| 11,313,603 | B2 * | 4/2022 | Kim | F25C 5/04 |
| 11,371,766 | B2 * | 6/2022 | Kang | F25C 1/25 |
| 11,874,044 | B2 * | 1/2024 | Lee | F25C 5/06 |
| 2004/0093878 | A1 | 5/2004 | Sanuki et al. | |
| 2006/0086135 | A1 | 4/2006 | Wu et al. | |
| 2007/0209381 | A1 | 9/2007 | Sugaya et al. | |
| 2007/0283714 | A1 | 12/2007 | Yoon et al. | |
| 2010/0176704 | A1 | 7/2010 | Kim | |
| 2013/0014535 | A1 | 1/2013 | Son et al. | |
| 2013/0014536 | A1 | 1/2013 | Son et al. | |
| 2013/0081412 | A1 | 4/2013 | Son et al. | |
| 2013/0327074 | A1 | 12/2013 | Lee et al. | |
| 2014/0165618 | A1 | 6/2014 | Culley et al. | |
| 2014/0165621 | A1 | 6/2014 | Boarman et al. | |
| 2014/0165624 | A1 | 6/2014 | Boarman et al. | |
| 2015/0075191 | A1 | 3/2015 | Gooden et al. | |
| 2016/0138844 | A1 | 5/2016 | Boarman et al. | |
| 2016/0223242 | A1 | 8/2016 | Garcia Gonzalez et al. | |
| 2018/0017307 | A1 | 1/2018 | Jeong et al. | |
| 2019/0293335 | A1 | 9/2019 | Bertolini et al. | |
| 2020/0158397 | A1 | 5/2020 | Hong et al. | |
| 2020/0158398 | A1 | 5/2020 | Kim et al. | |
| 2021/0364211 | A1 | 11/2021 | Xue et al. | |
| 2021/0381742 | A1 | 12/2021 | Lee et al. | |
| 2023/0221052 | A1 * | 7/2023 | Lim | F25C 5/06 62/340 |
| 2023/0258382 | A1 | 8/2023 | Yao et al. | |

FOREIGN PATENT DOCUMENTS

| | | | |
|---|---|---|---|
| CN | 102353193 | A | 2/2012 |
| CN | 102878743 | A | 1/2013 |
| CN | 102878744 | A | 1/2013 |
| CN | 107144065 | A | 9/2017 |
| CN | 108981253 | A | 12/2018 |
| CN | 111197890 | A | 5/2020 |
| CN | 111197893 | A | 5/2020 |
| CN | 213040813 | U | 4/2021 |
| CN | 213119630 | U | 5/2021 |
| CN | 113237278 | A | 8/2021 |
| CN | 113237279 | A | 8/2021 |
| CN | 113237281 | A | 8/2021 |
| CN | 113237282 | A | 8/2021 |
| CN | 113237283 | A | 8/2021 |
| CN | 113237284 | A | 8/2021 |
| CN | 113237285 | A | 8/2021 |
| CN | 215176404 | U | 12/2021 |
| CN | 215176405 | U | 12/2021 |
| CN | 215176406 | U | 12/2021 |
| EP | 3653964 | A1 | 5/2020 |
| EP | 3653974 | A1 | 5/2020 |
| EP | 3862668 | A1 | 8/2021 |
| EP | 3862682 | A1 | 8/2021 |
| EP | 3862689 | A1 | 8/2021 |
| TW | 1724966 | B | 4/2021 |
| WO | 2022092593 | A1 | 5/2022 |

OTHER PUBLICATIONS

Chinese Notification of the First Office Action dated Sep. 29, 2023 in corresponding Chinese Application No. 202110599135.4, translated, 11 pages.

Chinese Notification of the First Office Action dated Sep. 29, 2023 in corresponding Chinese Application No. 202110599218.3, translated, 11 pages.

Chinese Notification of the First Office Action dated Oct. 19, 2023 in corresponding Chinese Application No. 202110599421.0, translated, 15 pages.

International Search Report and Written Opinion dated Feb. 25, 2022 in corresponding International Application No. PCT/CN2021/121030, translated, 15 pages.

International Search Report and Written Opinion dated Mar. 1, 2022 in corresponding International Application No. PCT/CN2021/130756, translated, 15 pages.

International Search Report and Written Opinion dated Jun. 28, 2022 in corresponding International Application No. PCT/CN2022/084198, translated, 17 pages.

Chinese First Office Action dated Apr. 29, 2022 in corresponding Chinese Application No. 202110598608.9, translated, 17 pages.

Chinese First Office Action dated Apr. 29, 2022 in corresponding Chinese Application No. 202110598609.3, translated, 17 pages.

Chinese Second Office Action dated Oct. 19, 2022 in corresponding Chinese Application No. 202110598609.3, translated, 15 pages.

Chinese Decision of Rejection dated Mar. 21, 2023 in corresponding Chinese Application No. 202110598609.3, translated, 13 pages.

Chinese First Office Action dated Apr. 28, 2022 in corresponding Chinese Application No. 202110598792.7, translated, 17 pages.

Non-Final Office Action dated Mar. 20, 2025 in corresponding U.S. Appl. No. 18/348,820, 35 pages.

Non-Final Office Action mailed Jun. 13, 2025 in corresponding U.S. Appl. No. 18/348,901, 17 pages.

* cited by examiner

REFRIGERATOR

This application is a continuation application of International Application No. PCT/CN2021/130756, filed on Nov. 15, 2021, which claims priority to Chinese Patent Application No. 202110598609.3, filed on May 28, 2021, which are incorporated herein by reference in their entireties.

TECHNICAL FIELD

The present disclosure relates to the technical field of household appliances, and in particular, to a refrigerator.

BACKGROUND

With the increasing demand from consumers for functions of refrigerators, refrigerators with an ice making function are becoming more and more popular with the consumers.

A main component in the refrigerator to achieve the ice making function is an ice maker, and the ice maker is generally disposed in an ice making compartment separated from a refrigerating compartment or a freezing compartment. A basic principle of ice making includes: injecting water into an ice tray in the ice maker, then supplying cold to the ice making compartment to make the water in the ice tray freeze into an ice cube, and finally demolding the ice cube from the ice tray and dropping the ice cube into an ice storage box for access by a user.

SUMMARY

According to various embodiments of the disclosure, a refrigerator includes a refrigerator body and an ice maker. The refrigerator body defines an ice making compartment therein. The ice maker is disposed in the ice making compartment. The ice making includes a mold shell, a driving mechanism, a first push rod, a second push rod, and a connecting rod assembly. The mold shell has a mold cavity and a water inlet in communication with the mold cavity, and the mold shell includes a first sub-mold shell and a second sub-mold shell. One of the first sub-mold shell and the second sub-mold shell is fixed, and another of the first sub-mold shell and the second sub-mold shell is movable. The first sub-mold shell and the second sub-mold shell are configured to be switchable between a separated state and a closed state. The driving mechanism is configured to drive the first sub-mold shell or the second sub-mold shell to switch between the separated state and the closed state. The first push rod is located on a side of the first sub-mold shell away from the second sub-mold shell. The second push rod is located on a side of the second sub-mold shell away from the first sub-mold shell. One of the first push rod and the second push rod is fixed, and another of the first push rod and the second push rod is movable. The connecting rod assembly includes a connecting rod. An end of the connecting rod is connected to the movable one of the first sub-mold shell and the second sub-mold shell, and another end of the connecting rod is connected to the movable one of the first push rod and the second push rod.

BRIEF DESCRIPTION OF THE DRAWINGS

In order to describe the technical solutions of the embodiments of the present disclosure more clearly, accompanying drawings to be used in some embodiments of the present disclosure will be introduced briefly below. However, the accompanying drawings to be described below are merely accompanying drawings of some embodiments of the present disclosure, and a person of ordinary skill in the art may obtain other drawings according to these drawings. In addition, the accompanying drawings to be described below may be regarded as schematic diagrams and are not limitations on an actual size of a product, an actual process of a method, and an actual timing of a signal to which the embodiments of the present disclosure relate.

DETAILED DESCRIPTION

Figure 1:
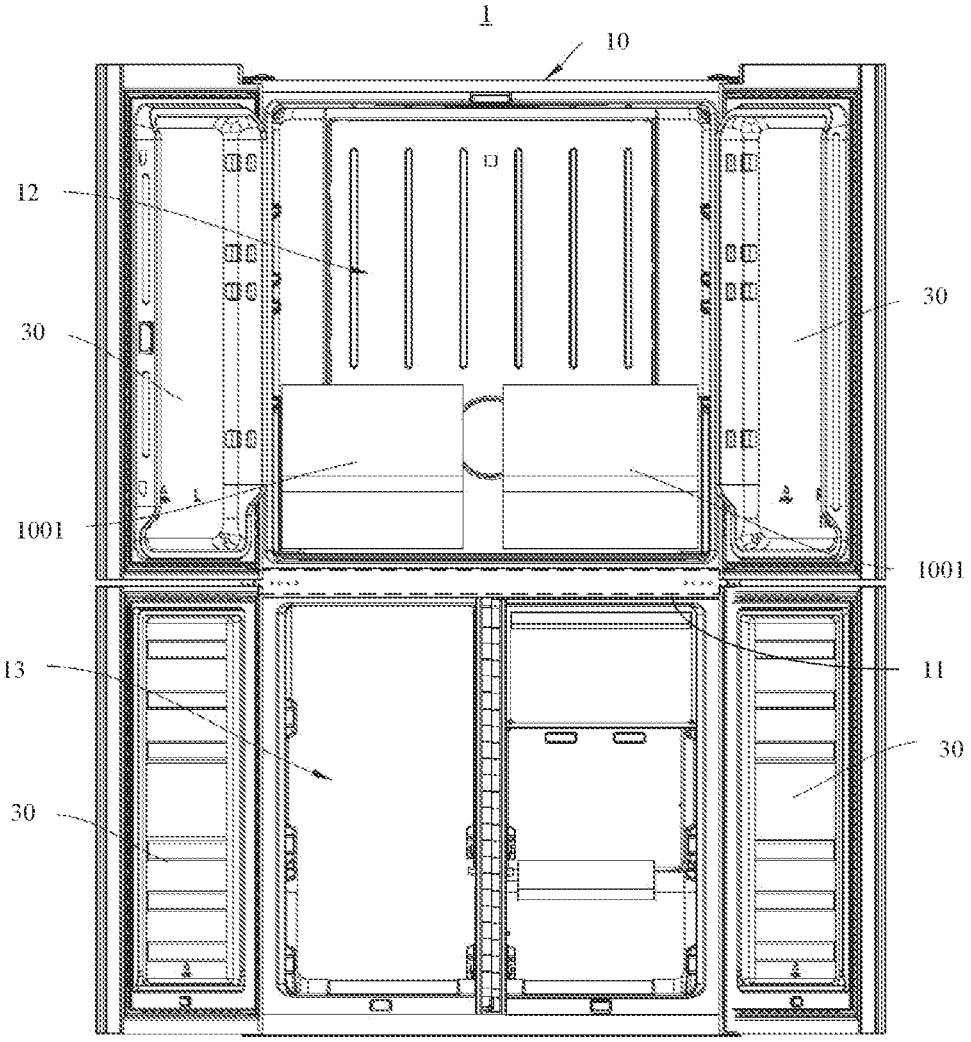
FIG. 1 is a diagram showing a structure of a refrigerator with a door body thereof in an open state, in accordance with some embodiments.

The technical solutions in some embodiments of the present disclosure will be described clearly and completely with reference to the accompanying drawings below. However, the described embodiments are merely some but not all embodiments of the present disclosure. All other embodiments obtained on a basis of the embodiments of the present disclosure by a person of ordinary skill in the art shall be included in the protection scope of the present disclosure.

Unless the context requires otherwise, throughout the specification and claims, the term "comprise" and other forms thereof such as the third-person singular form "comprises" and the present participle form "comprising" are construed as an open and inclusive meaning, i.e., "including, but not limited to." In the description of the specification, the terms such as "one embodiment," "some embodiments," "exemplary embodiments," "example," "specific example," or "some examples" are intended to indicate that specific features, structures, materials, or characteristics related to the embodiment(s) or example(s) are included in at least one embodiment or example of the present disclosure. Schematic representations of the above terms do not necessarily refer to the same embodiment(s) or example(s). In addition, specific features, structures, materials, or characteristics described herein may be included in any one or more embodiments or examples in any suitable manner.

In the description of the present disclosure, it will be understood that, orientations or positional relationships indicated by the terms such as "upper," "lower," "front," "rear," "left," "right," "vertical," "horizontal," "top," "bottom," "inner," "outer," and the like are based on orientations or positional relationships shown in the drawings, which are merely to facilitate and simplify the description of the present disclosure, and are not to indicate or imply that the devices or elements referred to must have a particular orientation, or must be constructed or operated in a particular orientation. Therefore, these terms should not be construed as limitations on the present disclosure.

Hereinafter, the terms "first" and "second" are only used for descriptive purposes and cannot be construed as indicating or implying the relative importance or implicitly indicating the number of indicated technical features. Therefore, the features defined with the terms "first" or "second" may explicitly or implicitly include one or more features. In the description of the embodiments of the present disclosure, the terms "a plurality of," "the plurality of," and "multiple" each mean two or more unless otherwise specified.

In the description of some embodiments, the expressions "coupled" and "connected" and derivatives thereof may be used. For example, the term "connected" may be used in the description of some embodiments to indicate that two or more components are in direct physical or electrical contact with each other. For another example, the term "coupled" may be used in the description of some embodiments to indicate that two or more components are in direct physical or electrical contact. However, the term "coupled" or "communicatively coupled" may also mean that two or more components are not in direct contact with each other but still cooperate or interact with each other. The embodiments disclosed herein are not necessarily limited to the content herein.

A side of a refrigerator 1 facing a user during use is defined as a front side, and a side opposite to the front side is defined as a rear side.

Figure 2:
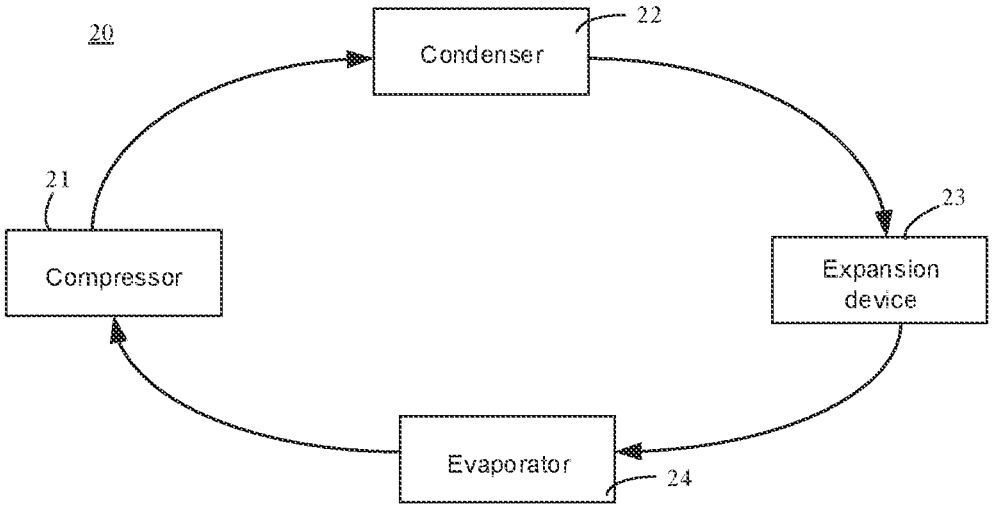
FIG. 2 is a schematic diagram of a cold air supply device of a refrigerator, in accordance with some embodiments.

In some embodiments, referring to FIGS. 1 and 2, the refrigerator 1 includes a refrigerator body 10, a cold air supply device 20, and a door body 30. The refrigerator body 10 includes a storage compartment, the cold air supply device 20 is configured to cool the storage compartment, and the door body 30 is configured to open and close the storage compartment.

The cold air supply device 20 cools the storage compartment by exchanging heat with the outside of the refrigerator body 10. As shown in FIG. 2, the cold air supply device 20 includes a compressor 21, a condenser 22, an expansion device 23, and an evaporator 24, and refrigerant circulates in a sequence of the compressor 21, the condenser 22, the expansion device 23, the evaporator 24, and the compressor 21 to cool the storage compartment.

For example, the evaporator 24 may be disposed in contact with an outer wall of the storage compartment, so as to directly cool the storage compartment. In some embodiments, the cold air supply device 20 may further include a circulation fan, so as to circulate air in the storage compartment through the evaporator 24 and the circulation fan.

The refrigerator body 10 includes a horizontal partition plate 11 disposed at a middle position of the refrigerator body 10 in a height direction. The height direction is referenced by an up-down direction in FIG. 1, and the horizontal partition plate 11 extends in a left-right direction in FIG. 1. A substantial position of the horizontal partition plate 11 is shown with reference to a dotted frame in FIG. 1. The storage compartment is partitioned into an upper storage compartment 12 and a lower storage compartment 13 by the horizontal partition plate 11. In some embodiments, the upper storage compartment 12 is served as a freezing compartment for storing foods in a freezing mode, and the lower storage compartment 13 is served as a refrigerating compartment for storing foods in a refrigerating mode.

In addition, the refrigerator 1 may further include an ice maker 1001, so that the refrigerator 1 has an ice making function. Ice cubes or ice water may be provided to the user by the ice maker 1001. In some embodiments, the ice maker 1001 is directly disposed in the freezing compartment. In this case, the freezing compartment is an ice making compartment. FIG. 1 shows an example in which the ice maker 1001 is disposed in the upper storage compartment 12 (i.e., the freezing compartment). Alternatively, an independent ice making compartment is defined by heat insulating plates in the refrigerating compartment or the freezing compartment, and the ice maker 1001 is disposed in the ice making compartment.

The door body 30 is pivotally connected to the refrigerator body 10, so as to open or close the storage compartment. For example, the door body 30 may be hinged to a front end of the refrigerator body 10. Four door bodies 30 are shown in FIG. 1.

Figure 3:
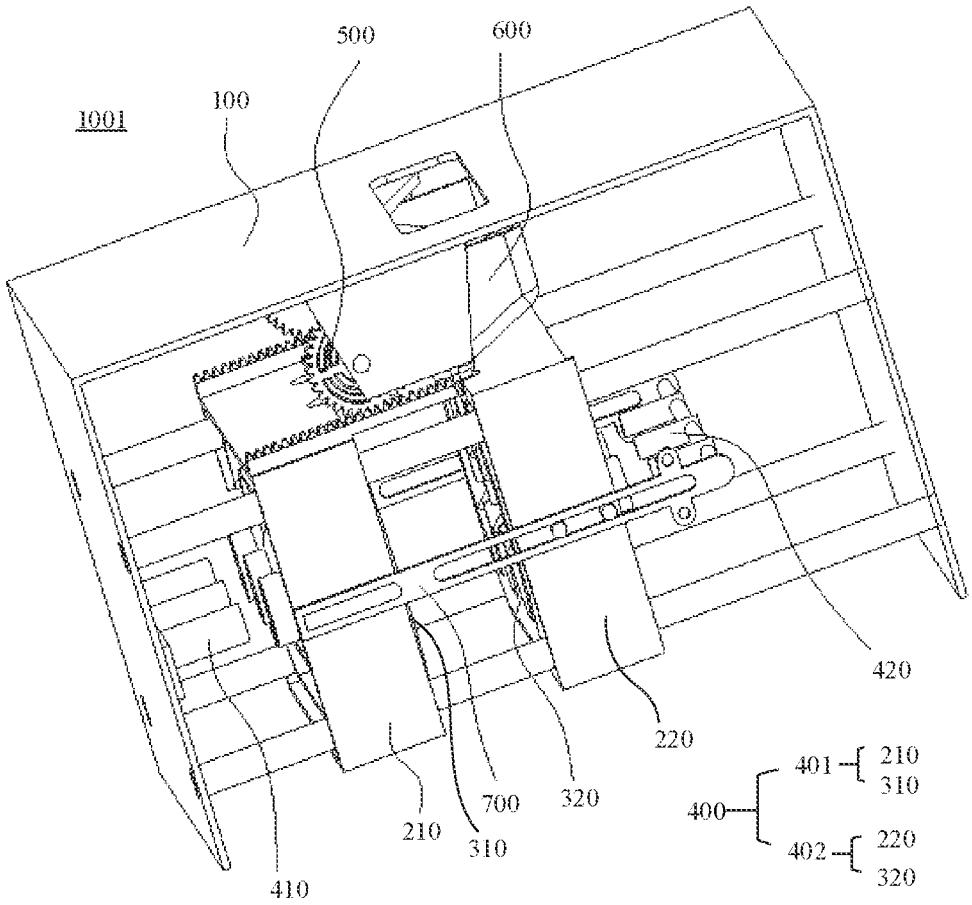
FIG. 3 is a diagram showing a structure of an ice maker, in accordance with some embodiments.

Referring to FIG. 3, the ice maker 1001 includes a base 100, a mold shell 400 (including a shell body 200 and a mold body 300), and a driving mechanism 500.

Figure 4:
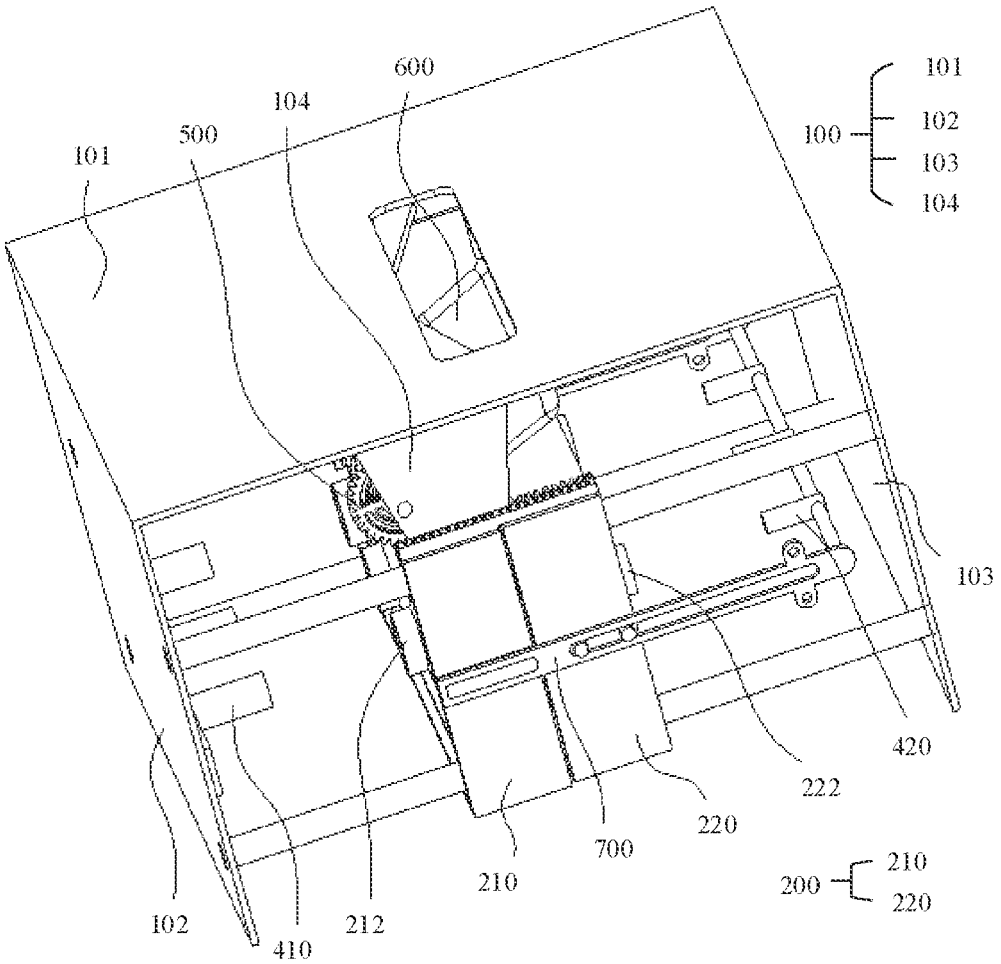
FIG. 4 is a diagram showing a structure of an ice maker in a closed state, in accordance with some embodiments.

Referring to FIG. 4, the base 100 is configured to be connected to the ice making compartment. The base 100 includes a plurality of side plates. For example, the plurality of side plates include an upper side plate 101, a left side plate 102, a right side plate 103, a front side plate 104, and a rear side plate. The left side plate 102 is opposite to the right side plate 103 in the left-right direction, the front side plate 104 is opposite to the rear side plate in a front-rear direction, and the upper side plate 101 is located above the left side plate 102, the right side plate 103, the front side plate 104, and the rear side plate. The directions "upper," "front," "rear," "left," and "right" as described in some embodiments of the present disclosure are defined for a clear description of a structure, which is not limited to be disposed in the ice making compartment in the front-rear direction as shown in FIG. 4 in an actual arrangement.

Figure 6:
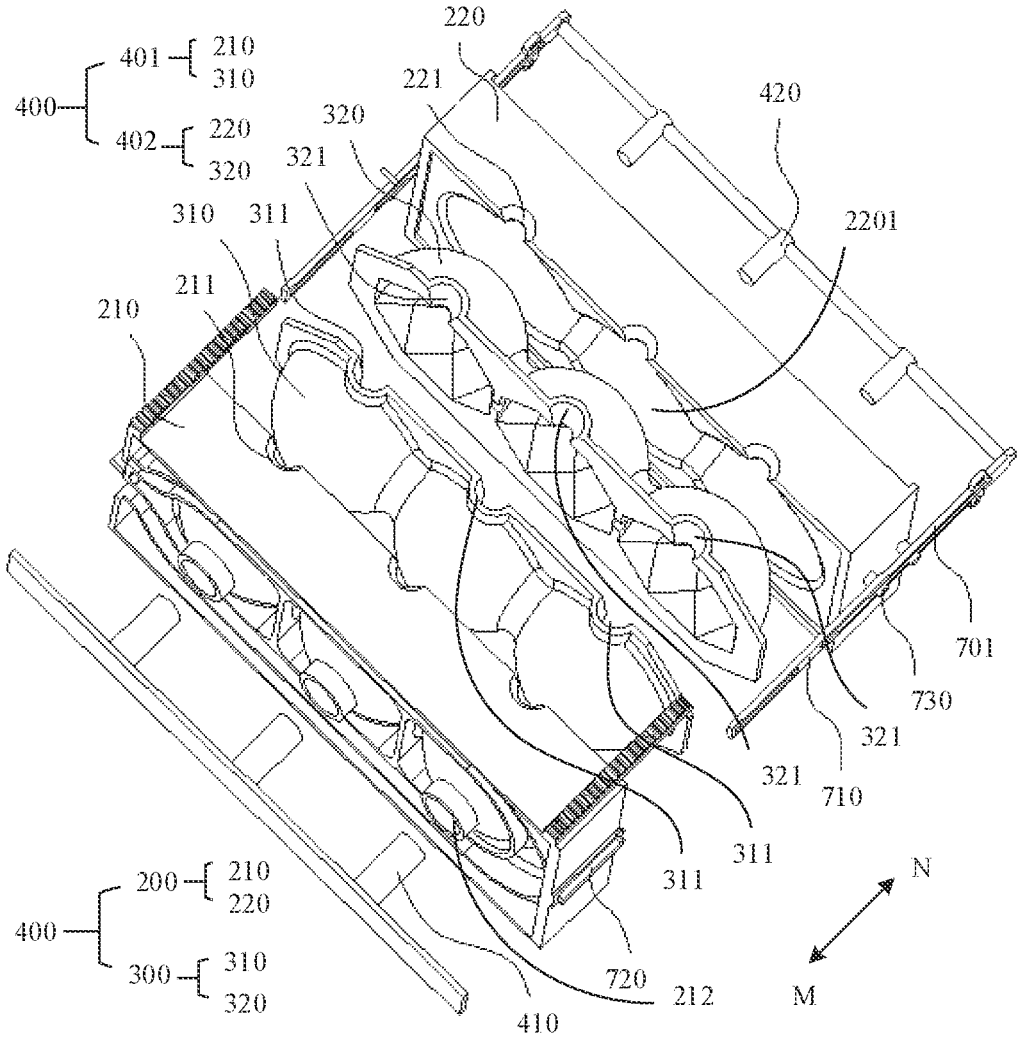
FIG. 6 is an exploded view of a shell body and a mold body of an ice maker, in accordance with some embodiments.

In some embodiments, as shown in FIG. 6, the mold shell 400 includes a first sub-mold shell 401 and a second sub-mold shell 402. The first sub-mold shell 401 and the second sub-mold shell 402 may switch between a separated state and a closed state. In the closed state, the first sub-mold shell 401 and the second sub-mold shell 402 enclose a mold cavity, which is a cavity enclosed by the first sub-mold shell 401 and the second sub-mold shell 402. A shape of the mold cavity depends on shapes of inner contours of the first sub-mold shell 401 and the second sub-mold shell 402. The shape of the mold cavity is a shape of an ice cube, and the shape of the mold cavity may be adaptively designed according to the requirements of the user. For example, the mold cavity may be designed to be of a sphere, a diamond-faced sphere, a polyhedron, or the like.

In some embodiments, one of the first sub-mold shell 401 and the second sub-mold shell 402 is fixed, and the other one of the first sub-mold shell 401 and the second sub-mold shell 402 is movable, so that the first sub-mold shell 401 and the second sub-mold shell 402 switch between the separated state and the closed state. During a process that the first sub-mold shell 401 and the second sub-mold shell 402 move from the closed state to the separated state, one of the first sub-mold shell 401 and the second sub-mold shell 402 that is movable moves in a direction away from the other one that is fixed. During a process that the first sub-mold shell 401 and the second sub-mold shell 402 move from the separated state to the closed state, one of the first sub-mold shell 401 and the second sub-mold shell 402 that is movable moves in a direction proximate to the other one that is fixed until they are closed.

Figure 5:
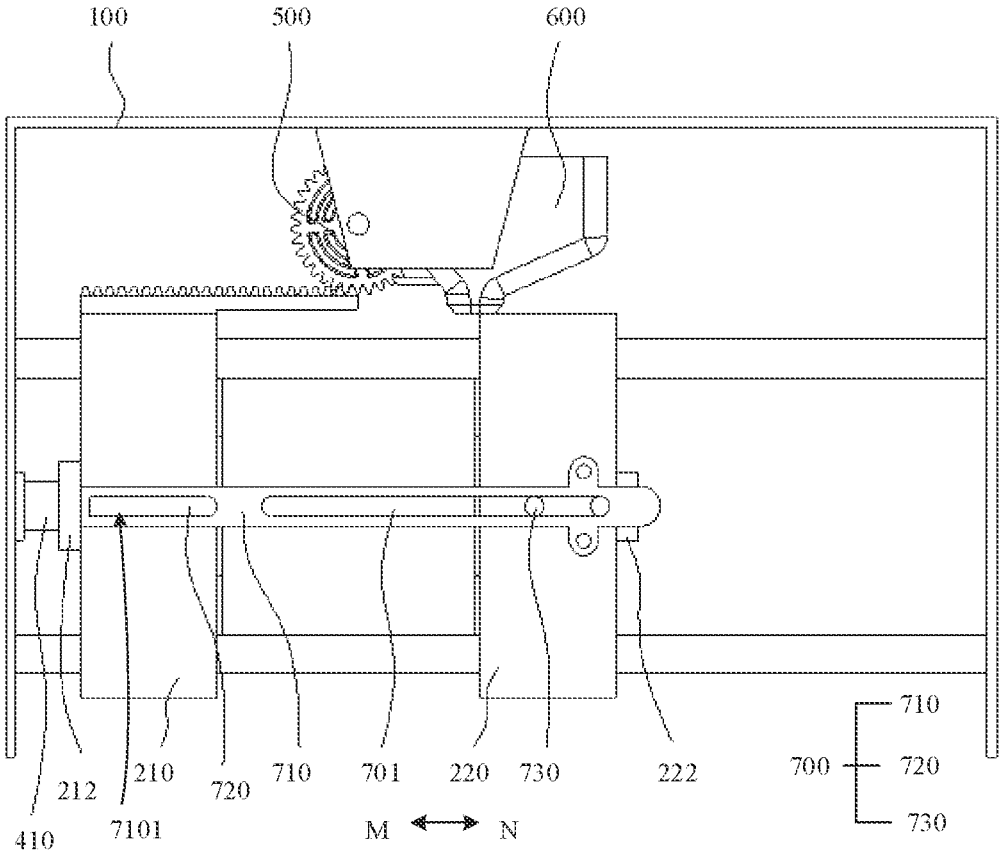
FIG. 5 is a diagram showing a structure of an ice maker in a separated state, in accordance with some embodiments.
Figure 8:
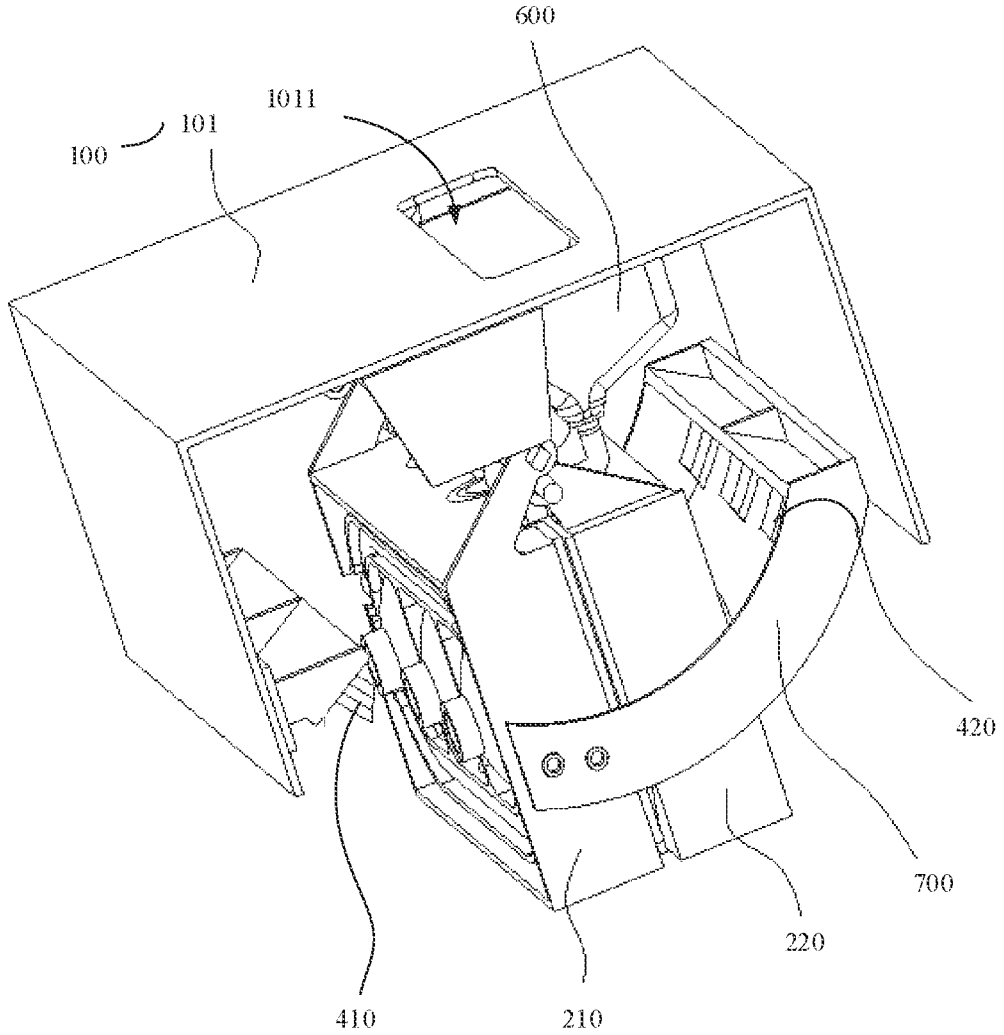
FIG. 8 is a diagram showing a structure of another ice maker, in accordance with some embodiments.
Figure 9:
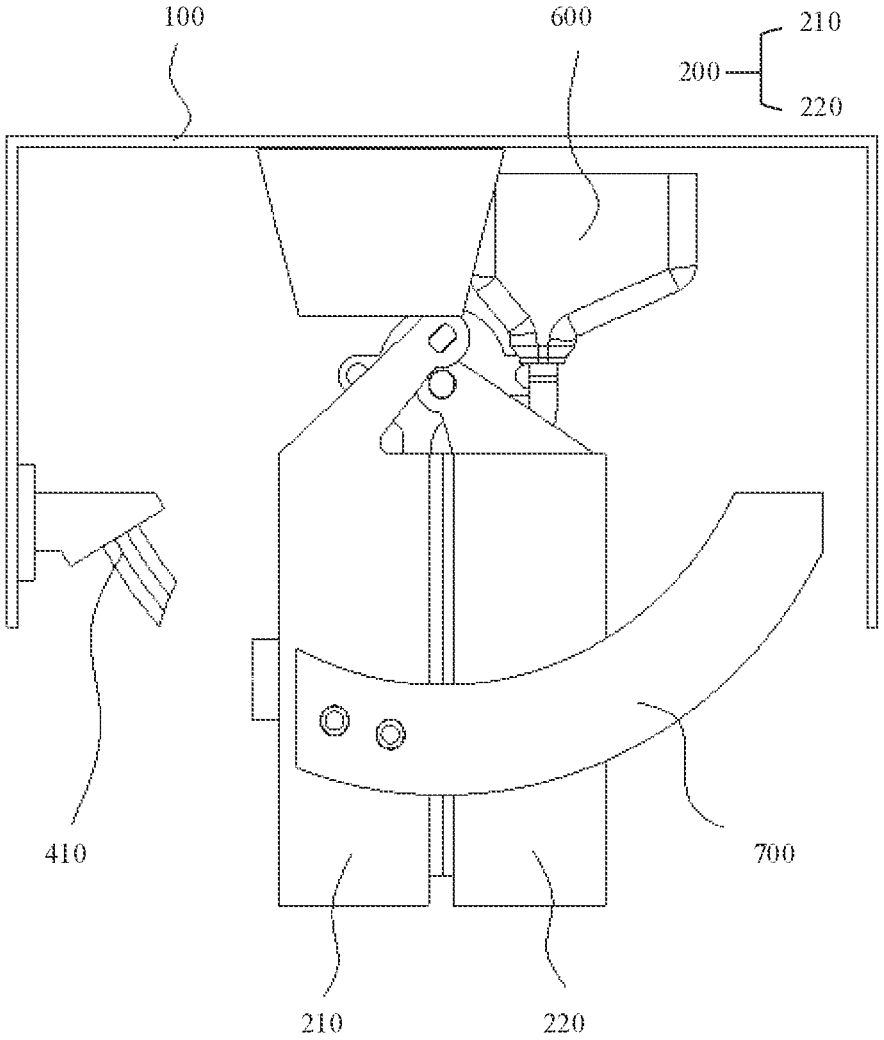
FIG. 9 is a diagram showing a structure of another ice maker in a closed state, in accordance with some embodiments.
Figure 10:
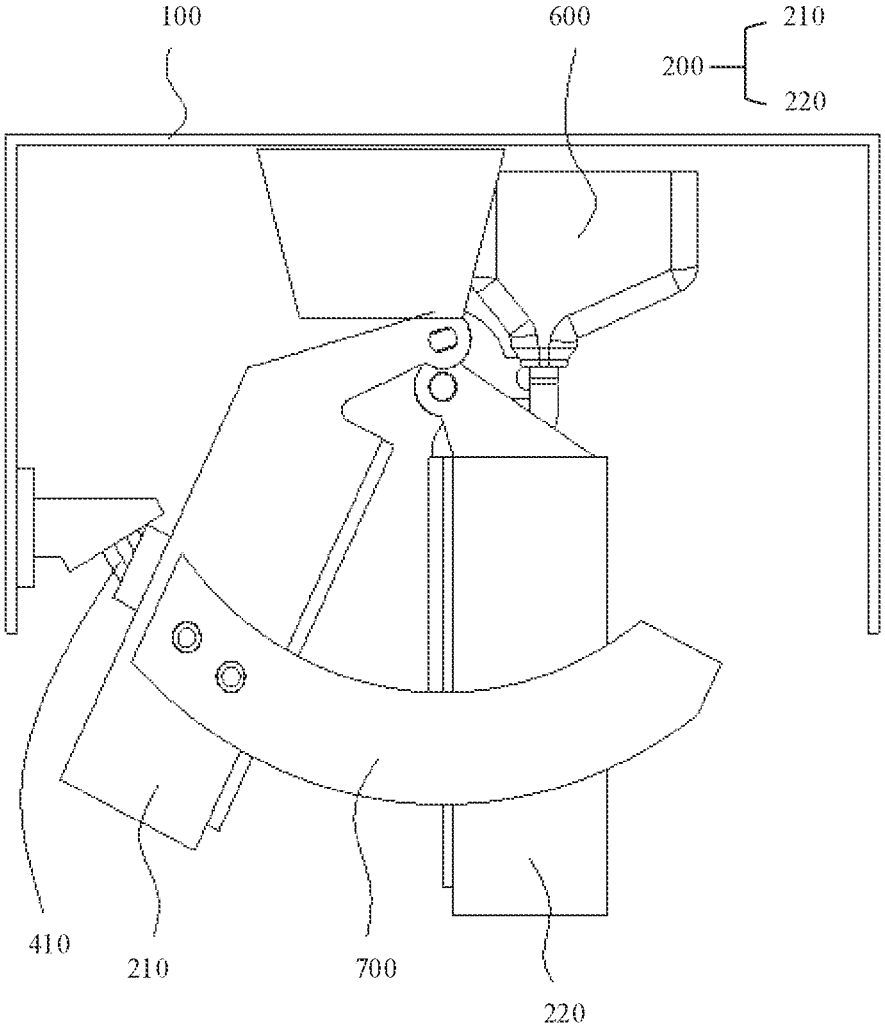
FIG. 10 is a diagram showing a structure of another ice maker in a separated state, in accordance with some embodiments.

For example, the first sub-mold shell 401 may be fixed, and the second sub-mold shell 402 may be movable with respect to the first sub-mold shell 401. Or, the second sub-mold shell 402 may be fixed, and the first sub-mold shell 401 may be movable with respect to the second sub-mold shell 402. FIGS. 4, 8 and 9 show that the first sub-mold shell 401 and the second sub-mold shell 402 are in the closed state, and FIGS. 5 and 10 show that the first sub-mold shell 401 and the second sub-mold shell 402 are in the separated state.

Of course, in some embodiments, the first sub-mold shell 401 and the second sub-mold shell 402 may both be movable.

A case where the mold shell 400 includes a plurality of sub-mold shells is similar to the case where the mold shell 400 includes the first sub-mold shell 401 and the second sub-mold shell 402 above, and the details will not be repeated herein.

For ease of description, some embodiments of the present disclosure will be described by taking an example in which the second sub-mold shell 402 is fixed, and the first sub-mold shell 401 is movable with respect to the second sub-mold shell 402. However, this should not be construed as a limitation of the present disclosure.

In some embodiments, the mold shell 400 includes a shell body 200 and a mold body 300.

It will be noted that the shell body 200 may also be referred to as a mold frame, and the mold body 300 may also be referred to as a mold. The mold shell 400 is composed of the mold frame and the mold.

Referring to FIGS. 3 and 6, the shell body 200 includes a first shell portion 210 and a second shell portion 220 that are disposed opposite to each other. For example, the first shell portion 210 and the second shell portion 220 are disposed opposite to each other in a direction MN shown in FIG. 6. The first shell portion 210 is located on the side M of the shell body 200, the second shell portion 220 is located on the side N of the shell body 200, and the direction MN corresponds to the left-right direction of the shell body 200. An inner wall of the first shell portion 210 includes a first inner cavity, and an inner wall of the second shell portion 220 defines a second inner cavity 2201 (referring to FIG. 6). The first inner cavity and the second inner cavity 2201 are disposed opposite to each other, and the first inner cavity and the second inner cavity 2201 may adopt a similar structure. The first shell portion 210 and the second shell portion 220 may switch between the separated state and the closed state. In the closed state, the first shell portion 210 and the second shell portion 220 are closed to form an inner cavity, and the inner cavity is collectively defined by the first inner cavity and the second inner cavity 2201.

Referring to FIG. 6, the mold body 300 is disposed in the inner cavity, and the mold body 300 includes a first mold portion 310 and a second mold portion 320. The first mold portion 310 is connected to the first shell portion 210, so that the first mold portion 310 moves along with the first shell portion 210. For example, the first mold portion 310 is attached to the first inner cavity of the first shell portion 210, the first mold portion 310 includes a first concave cavity, and the first concave cavity is located on a side of the first mold portion 310 facing toward the second mold portion 320. The second mold portion 320 is connected to the second shell portion 220, so that the second mold portion 320 is fixed with respect to the second shell portion 220. For example, the second mold portion 320 is attached to the second inner cavity of the second shell portion 220, the second mold portion 320 includes a second concave cavity 3201 (referring to FIG. 13), and the second concave cavity 3201 is located on a side of the second mold portion 320 facing toward the first mold portion 310. The first mold portion 310 and the second mold portion 320 may switch between the separated state and the closed state. In the closed state, the first mold portion 310 and the second mold portion 320 are closed to form a mold cavity, and the mold cavity is collectively defined by the first concave cavity and the second concave cavity 3201.

It will be understood that, by providing the shell body 200 to the mold body 300, the shell body 200 may provide good support to the mold body 300. Therefore, there is no need to add structural members in the mold shell 400 to fix the mold body 300, which is conducive to facilitating the assembly of the ice maker 1001 and is conducive to reducing the production cost of the refrigerator 1.

Figure 13:
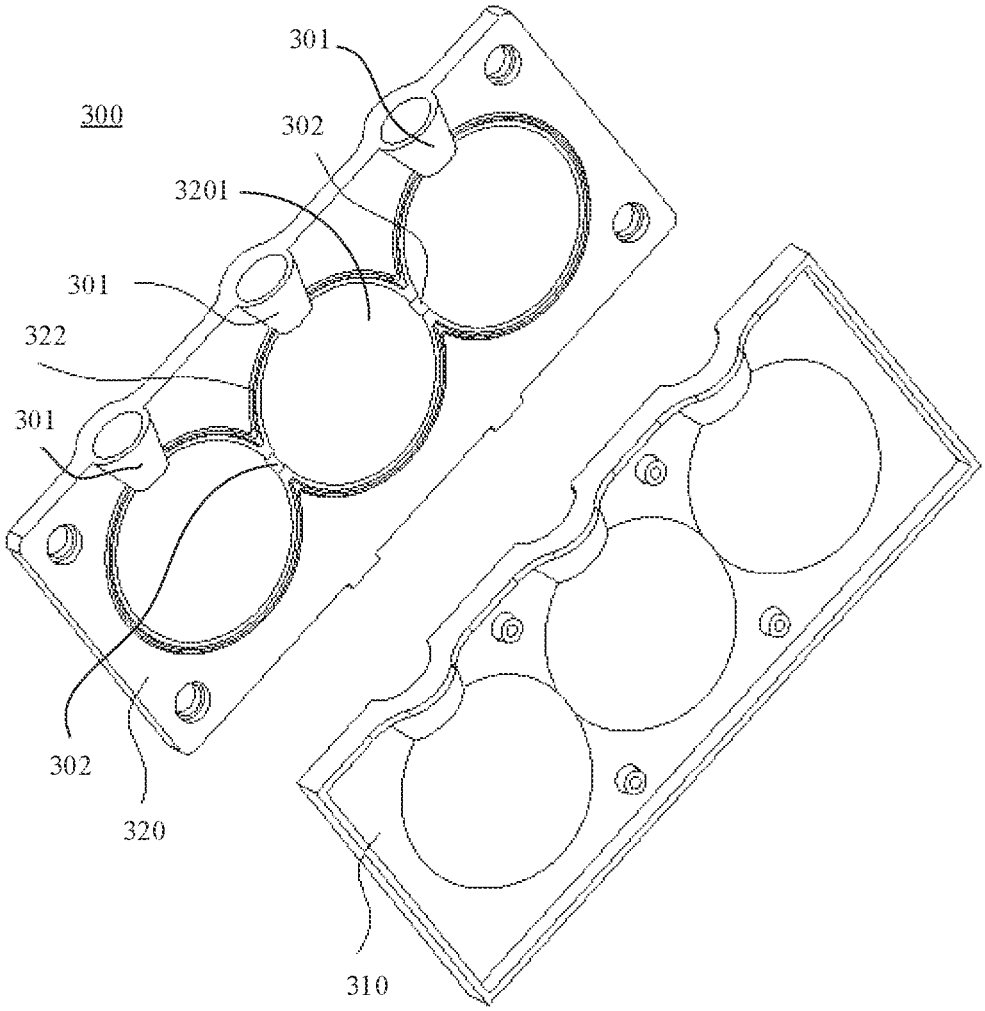
FIG. 13 is an exploded view of a mold body of an ice maker, in accordance with some embodiments.

In some embodiments, referring to FIGS. 6 and 13, an edge of the first concave cavity of the first mold portion 310 is provided with a first engaging portion, an edge of the second concave cavity 3201 of the second mold portion 320 is provided with a second engaging portion 322 (referring to FIG. 13), and the second engaging portion 322 is configured to be matched with the first engaging portion.

For example, one of the first engaging portion and the second engaging portion 322 is a convex rib, the other one of the first engaging portion and the second engaging portion 322 is a groove, and the groove is matched with the convex rib. In this way, by means of the mutual cooperation between the first engaging portion and the second engaging portion 322, it is conducive to improving the fitting accuracy between the first mold portion 310 and the second mold portion 320, and improving the appearance aesthetics of the ice cube, so that it may be possible to avoid a situation that the ice cube forms a convex edge at a joining position between the first mold portion 310 and the second mold portion 320, which may cause the appearance of the ice cube to be irregular and affect the appearance aesthetics of the ice cube.

In some embodiments, one of the first engaging portion and the second engaging portion 322 may also be configured as a protruding portion or a raised portion, and the other one of the first engaging portion and the second engaging portion 322 may also be configured as a concave portion or a slot. As long as the first engaging portion and the second engaging portion 322 are capable of matching together, the present disclosure is not limited thereto.

In some embodiments, at least one of the first mold portion 310 or the second mold portion 320 is configured to be deformed due to an action of an external force. For example, the first mold portion 310 and the second mold portion 320 are both silicone members.

Figure 12:
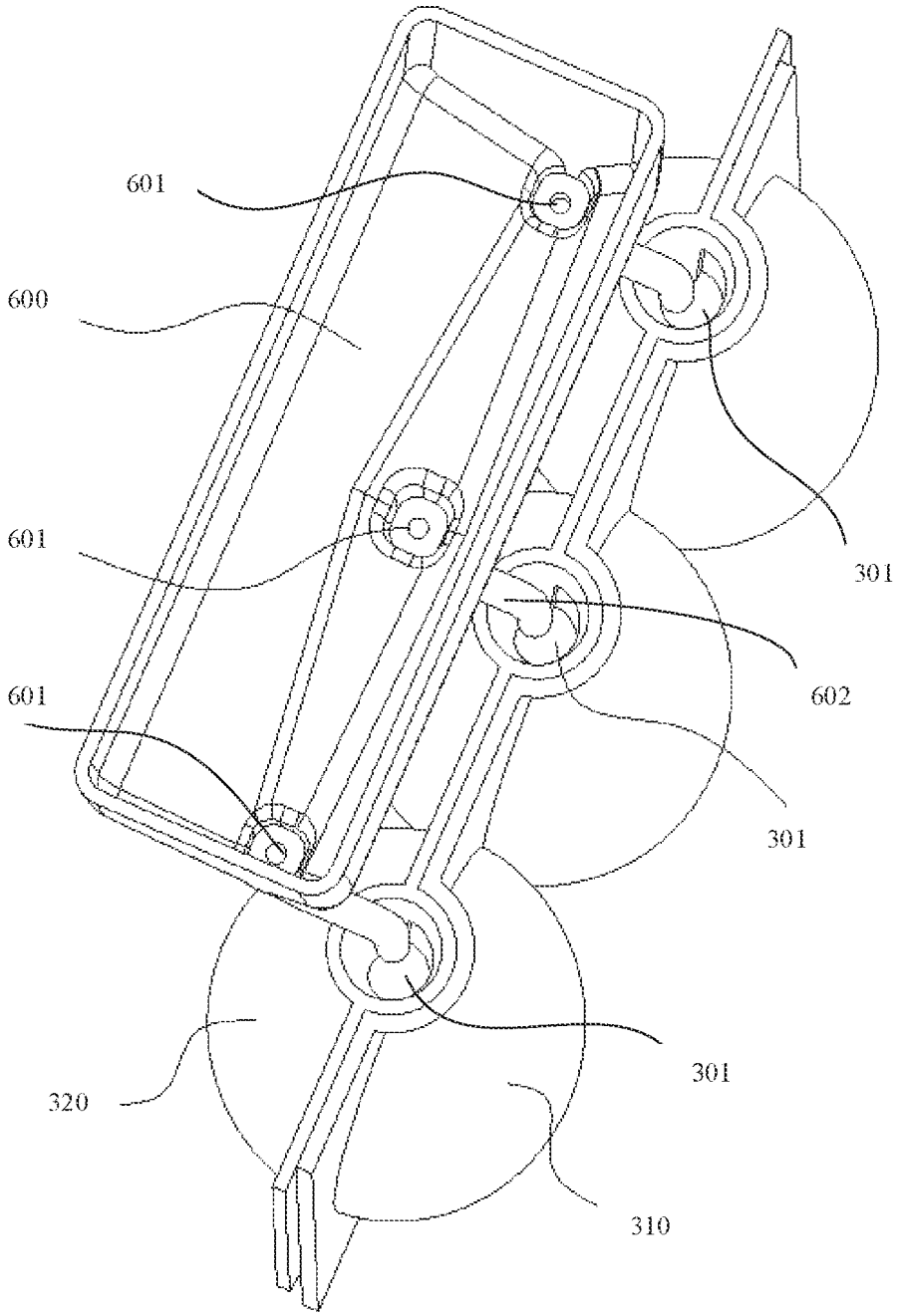
FIG. 12 is a diagram showing a structure of a water tank and a mold body of an ice maker, in accordance with some embodiments.

Referring to FIGS. 6 and 12, the mold body 300 includes a water inlet 301 communicated with the mold cavity, a position of the upper side plate 101 of the base 100 corresponding to the water inlet 301 is provided with an opening 1011 (referring to FIG. 8), and an external water tube is connected to the water inlet 301 by passing through the opening 1011, so as to inject water into the mold cavity. For example, the opening 1011 is formed as a rectangular through hole penetrating the upper side plate 101 in a thickness direction.

In some embodiments, the mold body 300 includes a plurality of mold cavities. FIG. 12 shows an example in which the mold body 300 includes three mold cavities, and each mold cavity includes a water inlet 301. A water tank 600 is disposed above the shell body 200, the water tank 600 includes a plurality of water dispensing ports 601 each corresponding to a water inlet 301, and a position of the water dispensing port 601 is provided with a water dispensing tube 602 communicated with the water inlet 301. Referring to FIG. 4, the water tank 600 is fixed to the base 100. The opening 1011 is disposed at a position of the upper side plate 101 corresponding to the water tank 600 (referring to FIG. 8). The arrangement of the plurality of mold cavities may increase an amount of ice produced by the ice maker 1001 in a single time, and the water tank 600 provided with the plurality of water dispensing ports 601 is beneficial to improve the efficiency of water injection, thereby effectively increasing the ice making efficiency.

In some embodiments, referring to FIG. 13, the plurality of mold cavities are communicated through a plurality of water holes 302. For example, the mold body 300 in FIG. 13 includes three mold cavities, two adjacent mold cavities are communicated with each other through a water hole 302, so that water injected into a mold cavity may circulate in different mold cavities, thus water in the plurality of mold cavities tends to be averaged, which is beneficial to reduce weight difference of the produced ice cubes.

In some embodiments, the water inlet 301 is formed as a separate structure. For example, as shown in FIG. 6, a top of the first mold portion 310 is provided with a first concave portion 311, and a top of the second mold portion 320 is provided with a second concave portion 321. When the first mold portion 310 and the second mold portion 320 are in the closed state, the first concave portion 311 and the second concave portion 321 are closed to form the water inlet 301.

Due to the presence of manufacturing tolerances, water may leak at the water inlet 301 of the separate structure during water injection. Since the amount of water injected in a single time is constant, if water leaks during water injection, the amount of water injected into the mold cavity will be reduced, and the weight of the produced ice cube will be less than the predetermined weight of the ice cube, which results in a decrease in integrity of the ice cube.

In some embodiments, the water inlet 301 is formed as an integral structure. Referring to FIG. 13, the water inlet 301 is formed as a closed shape (e.g., ring shaped). For example, the water inlet 301 is formed as an annular structure, and the water inlet 301 is defined at the inside of the annular structure. FIG. 13 shows an example in which the water inlet 301 is funnel-shaped. By adopting the water inlet 301 of a closed shape, it may be possible to avoid water leakage, thereby achieving a good integrity of the ice cube.

It will be understood that, if a half of the water inlet 301 is located in the first mold portion 310, and the other half of the water inlet 301 is located in the second mold portion 320, in a case where water leaks out of the mold cavity at the jointing position between the first mold portion 310 and the second mold portion 320, leaked water after being frozen may cause the mold portions to be adhered to each other, which may result in difficulty in separating the first mold portion 310 from the second mold portion 320 in a subsequent demolding process and lead to an unsmooth demolding process.

In some embodiments, the water inlet 301 is formed on the first mold portion 310 or the second mold portion 320. FIG. 13 shows an example in which the water inlet 301 is formed on the second mold portion 320, and the water inlet 301 and the second mold portion 320 form a one-piece member. Of course, in some embodiments, the water inlet 301 may also be formed on the first mold portion 310, and the water inlet 301 and the first mold portion 310 form a one-piece member. Therefore, by forming the water inlet 301 separately on the first mold portion 310 or the second mold portion 320, instead of combing two halves, it may be possible to reduce the difficulty of the demolding process and improve the smoothness of the demolding process.

The refrigerator 1 in some embodiments of the present disclosure, by providing the water inlet 301 into an integral structure and providing the water inlet 301 on the first mold portion 310 or the second mold portion 320, it may effectively avoid water leakage from the water inlet 301 during water injection, thereby preventing leaked water from flowing outside the mold shell 400 and condensing into ice, which would affect normal operation of the ice maker 1001. In this way, it is conducive to improving water injection efficiency of the ice maker 1001.

Referring to FIG. 6, the first shell portion 210 includes a first groove 211 located on a side of the first shell portion 210 proximate to the second shell portion 220, and the second shell portion 220 includes a second groove 221 located on a side of the second shell portion 220 proximate to the first shell portion 210. In a case where the first shell portion 210 and the second shell portion 220 are in the closed state, the first groove 211 and the second groove 221 are closed to form an avoidance opening that encloses an outer circumference of the water inlet 301, and the water inlet 301 is located in the avoidance opening.

As shown in FIG. 6, the first sub-mold shell 401 includes a first shell portion 210 and a first mold portion 310. The ice maker 1001 includes at least one of a first push rod 410 or a second push rod 420. The first push rod 410 or the second push rod 420 is disposed corresponding to the mold cavity.

The first push rod 410 is located at a position from a first predetermined distance of the first shell portion 210 away from the second shell portion 220, and the first push rod 410 is fixed to the left side plate 102. It will be noted that the first predetermined distance is a distance set based on factors such as a length of the first push rod 410 and a size of an internal space of the ice maker 1001. The first shell portion 210 includes a first through hole 212, and the first through hole 212 is matched with the first push rod 410. For example, in FIG. 6, the first shell portion 210 includes the first through hole 212, and a position from the first predetermined distance on the side M of the first shell portion 210 is provided with the first push rod 410. In FIG. 5, the first push rod 410 passes through the through hole 212.

The ice maker 1001 further includes the second push rod 420 located at a position from a second predetermined distance of the second shell portion 220 away from the first shell portion 210. The second shell portion 220 includes a second through hole 222 (referring to FIG. 4), and the second through hole 222 is matched with the second push rod 420. It will be noted that the second predetermined distance is a distance set based on factors such as a length of the second push rod 420 and the size of the internal space of the ice maker 1001.

In some embodiments, referring to FIG. 6, a side surface of the first push rod 410 adjacent to the first mold portion 310 is matched with a contour surface of the first concave cavity of the first mold portion 310, and a side surface of the second push rod 420 adjacent to the second mold portion 320 is matched with a contour surface of the second concave cavity of the second mold portion 320. Therefore, it facilitates the first push rod 410 to be closely and effectively fitted onto the first mold portion 310, thereby enabling the first mold portion 310 to undergo effective deformation. It facilitates the second push rod 420 to be closely and effectively fitted onto the second mold portion 320, thereby enabling the second mold portion 320 to undergo effective deformation, so as to demold the ice cube in the first mold portion 310 and the second mold portion 320.

The driving mechanism 500 is configured to drive the first sub-mold shell 401 to move, and the second sub-mold shell 402 is fixed. For example, the driving mechanism 500 is configured to drive the first shell portion 210 to move, so that the first shell portion 210 is separated from or closed with the second shell portion 220 that is fixed. The first mold portion 310 moves along with the first shell portion 210, and the second mold portion 320 is fixed with respect to the second shell portion 220.

In some embodiments, the ice maker 1001 further includes a connecting rod assembly 700, the first push rod 410 is fixed, and the second push rod 420 is linked with the first shell portion 210 by the connecting rod assembly 700. In FIG. 4, the first shell portion 210 and the second shell portion 220 are in the closed state. In FIG. 5, the first shell portion 210 and the second shell portion 220 are in the separated state.

In an actual ice making process, when the first shell portion 210 is separated from the second shell portion 220, the ice cube may be adhered in the first mold portion 310 or the second mold portion 320. In some embodiments, when demolding, the driving mechanism 500 drives the first shell portion 210 to move to a predetermined position, and the first push rod 410 passes through the first through hole 212 to push against the first mold portion 310, so that the first mold portion 310 is deformed due to stress. Since the second push rod 420 is linked with the first shell portion 210 by the connecting rod assembly 700, the second push rod 420 may be moved along with the movement of the first shell portion 210. The second push rod 420 passes through the second through hole 222 to push against the second mold portion 320, so that the second mold portion 320 is deformed due to stress.

For example, as shown in FIG. 5, the driving mechanism 500 drives the first shell portion 210 to move toward the first push rod 410 to a predetermined position, so that the first push rod passes through the first through hole 212 to push against the first mold portion 310, thus the first mold portion 310 is deformed due to stress, and the ice cube in the first mold portion 310 is demolded. Moreover, the first shell portion 210 drives the second push rod 420 to move toward the second through hole 222 through the connecting rod assembly 700, so that the second push rod 420 passes through the second through hole 222 to push against the second mold portion 320, thus the second mold portion 320 is deformed due to stress, and the ice cube in the second mold portion 320 is demolded. Therefore, the ice cube located in either the first mold portion 310 or the second mold portion 320 may be pushed out evenly and dropped into an ice storage box of the refrigerator 1 for access by the user, which has a good demolding effect.

The refrigerator 1 of some embodiments of the present disclosure includes the ice maker 1001. The ice tray of the ice maker 1001 includes the first sub-mold shell 401 and the second sub-mold shell 402. One of the first sub-mold shell 401 and the second sub-mold shell 402 is fixed, and the other one of the first sub-mold shell 401 and the second sub-mold shell 402 is movable, so that the first sub-mold shell 401 and the second sub-mold shell 402 may switch between the separated state and the closed state. The ice maker 1001 is adapted to make specially shaped ice cubes that may only be formed by combing two sub-mold shells, such as spherical ice cubes or polyhedral ice cubes.

Moreover, the first sub-mold shell 401 is movable, a side of the first sub-mold shell 401 away from the second sub-mold shell 402 is provided with the first push rod 410 that is fixed; the second sub-mold shell 402 is fixed, and a side of the second sub-mold shell 402 away from the first sub-mold shell 401 is provided with the second push rod 420. The second push rod 420 is linked with the first sub-mold shell 401 by the connecting rod assembly 700. Upon demolding, the first sub-mold shell 401 moves to a predetermined position, the first push rod 410 may push the ice cube out of the first mold portion 310, and the second push rod 420 may push the ice cube out of the second mold portion 302. The demolding structure is simple and the demolding effect thereof is reliable.

In addition, by adopting the technical solution that one of the first sub-mold shell 401 and the second sub-mold shell 402 is fixed, and the other one of the first sub-mold shell 401 and the second sub-mold shell 402 is movable, the required driving mechanism is of a simple structure, thus the space occupied by the ice maker 1001 is relatively small.

In some embodiments, an opening-closing movement manner of the first shell portion 210 and the second shell portion 220 includes at least a translational manner or a rotational manner. Hereinafter, a matched driving mechanism 500 is provided with respect to the translational manner or the rotational manner.

Figure 7:
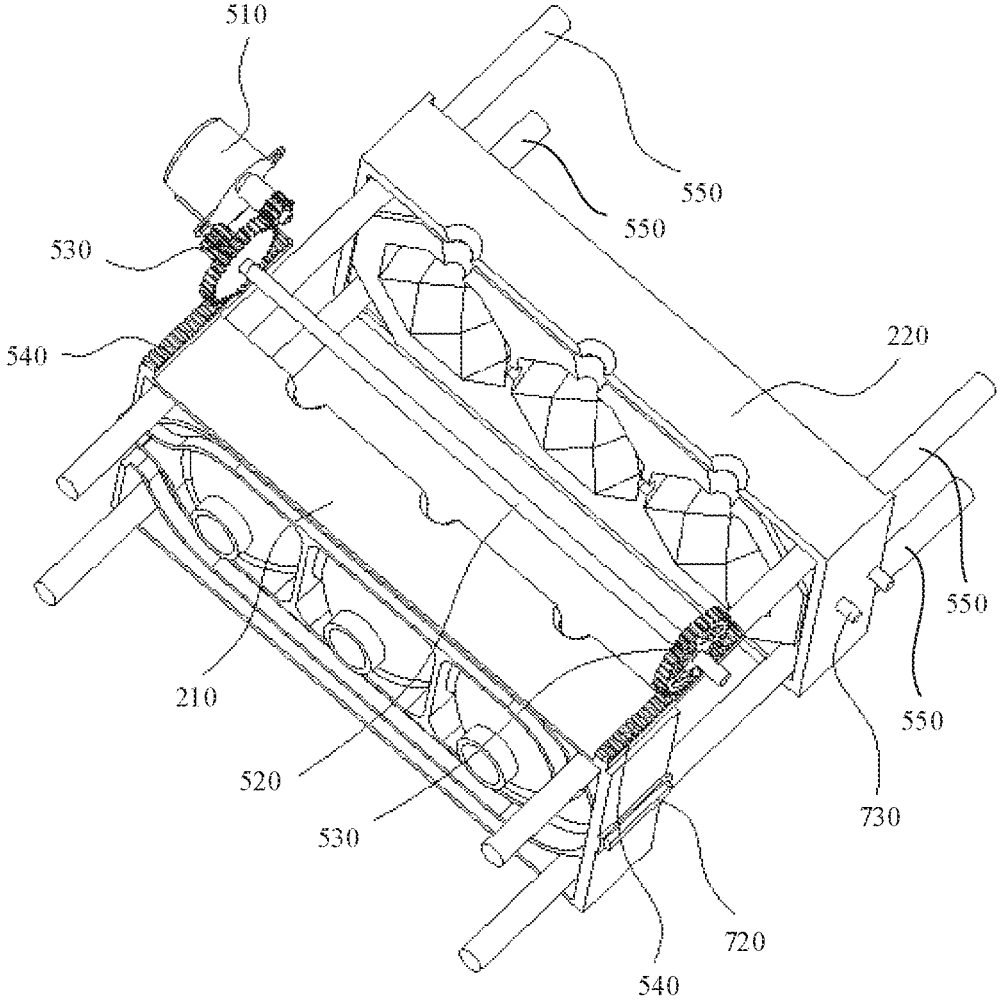
FIG. 7 is a diagram showing a structure of a driving mechanism and a shell body of a refrigerator, in accordance with some embodiments.

Referring to FIG. 7, in a case where the first shell portion 210 adopts a translational opening-closing movement, the driving mechanism 500 includes a motor 510, a rotating shaft 520, a gear set 530, a rack 540, and a slide rod 550.

The driving mechanism 500 includes two racks 540 disposed on two sides of a top of the first shell portion 210 in a movement direction (for example, the movement direction is the left-right direction, and an arrangement direction of the two racks 540 is a front-rear direction). The driving mechanism 500 includes four slide rods 550, and the four slide rods 550 are passed through and installed at four corners of the first shell portion 210 and four corners of the second shell portion 220, respectively.

For example, the motor 510 is connected to the rotating shaft 520, and the rack 540 is drivingly connected to the rotating shaft 520 through the gear set 530. Therefore, the motor 510 is able to drive the rotating shaft 520 to rotate, the rotating shaft drives the gear set 530 to rotate, and the gear set 530 drives the rack 540 to move, so that the first shell portion 210 translates along the slide rod 550. FIG. 4 shows that the driving mechanism 500 drives the first shell portion 210 to move to be in the closed state, and FIG. 5 shows that the driving mechanism 500 drives the first shell portion 210 to move to be in the separated state.

Referring to FIGS. 4 to 6, in the case where the first shell portion 210 adopts the translational opening-closing movement, the connecting rod assembly 700 includes a connecting rod 710, a first buckle portion 720, and a second buckle portion 730.

In some embodiments, an extending direction of the connecting rod 710 is substantially the same as the movement direction of the first shell portion 210. For example, when the first shell portion 210 moves in the direction MN in FIG. 5, the connecting rod 710 is in a shape of a straight rod extending in the direction MN. An end of the connecting rod 710 adjacent to the first shell portion 210 is provided with a fixing hole 7101, and another end of the connecting rod 710 adjacent to the second shell portion 220 is connected to the second push rod 420 (referring to FIG. 4). For example, at least one of the front surface or the rear surface of the first shell portion 210 is provided with the first buckle portion 720, and the first buckle portion 720 is matched with the fixing hole 7101, so that the first shell portion 210 is connected to the connecting rod 710. The first buckle portion 720 may be formed as a convex structure that extends in a same direction as the rack 540.

The connecting rod 710 includes a strip-shaped hole 701, and the strip-shaped hole 701 is formed as a through hole penetrating the connecting rod 710 in the thickness direction thereof. At least one of the front surface or the rear surface of the second shell portion 220 is provided with the second buckle portion 730, and the second buckle portion 730 is passed through and installed in the strip-shaped hole 701, so that the connecting rod 710 translates with respect to the second buckle portion 730. The front surface (or the rear surface) of the second shell portion 220 is provided with one or more second buckle portions 730, and the second buckle portion 730 may be formed as a shaft-like structure that extends away from the front surface or the rear surface of the second shell portion 220.

Figure 11:
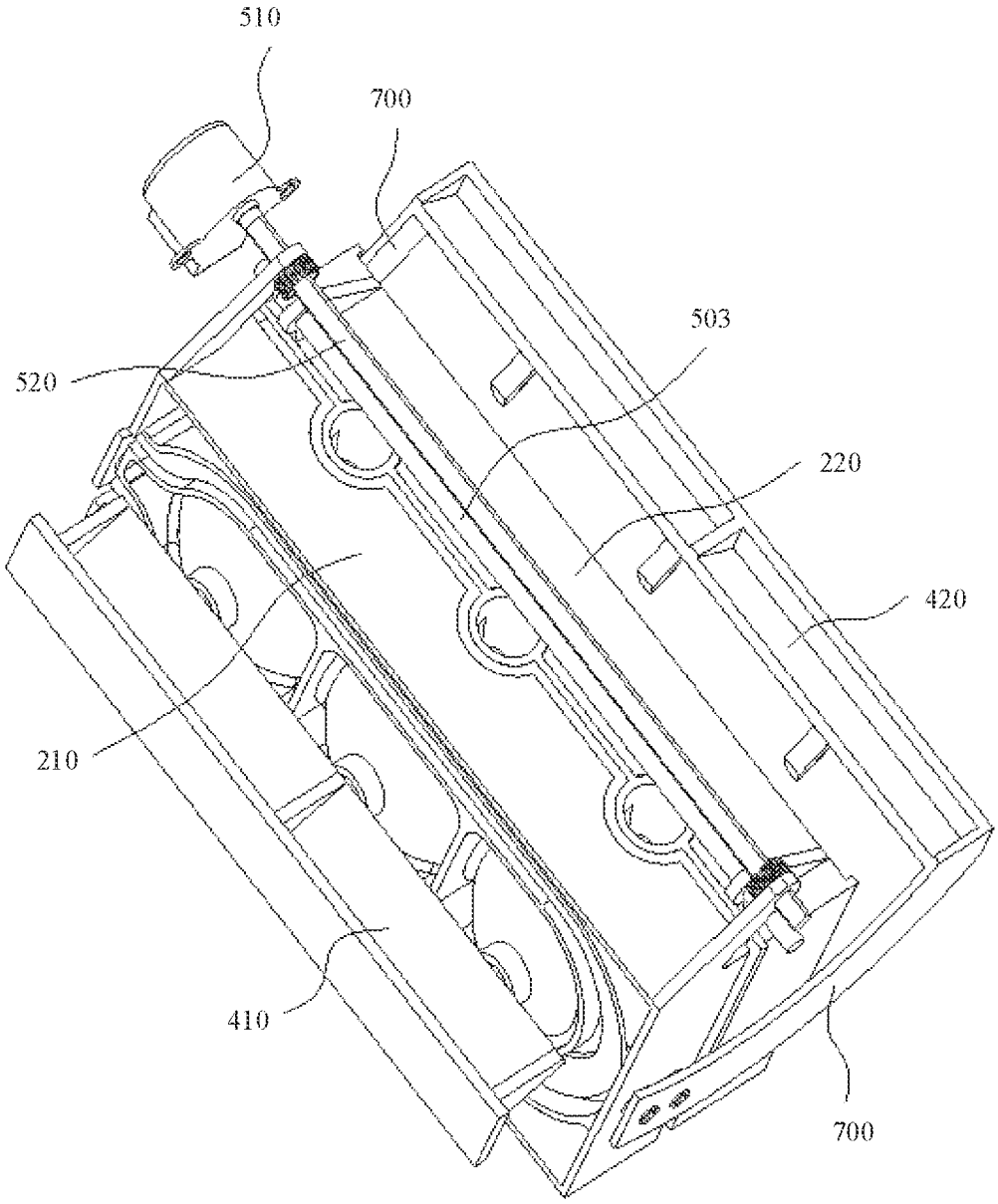
FIG. 11 is a diagram showing a structure of a driving mechanism and a shell body of another ice maker, in accordance with some embodiments.

Referring to FIG. 11, in a case where the first shell portion 210 adopts the rotational opening-closing movement, the driving mechanism 500 includes a motor 510 and a rotating shaft 520, and the motor 510 is connected to the rotating shaft 520 to drive the rotating shaft 520 to rotate. The first shell portion 210 is connected to the rotating shaft 520, so that the rotation of the rotating shaft 520 may make the first shell portion 201 rotate in a predetermined direction.

FIG. 10 shows that the driving mechanism 500 drives the first shell portion 210 to move to be in the separated state. When water in the mold body 300 condenses into ice cubes, the motor 510 may drive the rotating shaft 520 to rotate, so as to drive the first shell portion 210 to rotate in a first predetermined direction (e.g., a clockwise direction). When the first shell portion 210 moves to the predetermined position, the first push rod 410 may push the ice cubes out of the first mold portion 310. While the first shell portion 210 is rotating, the first shell portion 210 drives the second push rod 420 to rotate, so as to push the ice cubes out of the second mold portion 320.

FIGS. 8 and 9 show that the driving mechanism 500 drives the first shell portion 210 to move to be in the closed state. It will be understood that after the ice cubes are pushed out of the mold body 300, the motor 510 may drive the rotating shaft 520 to rotate, so that the first shell portion 210 rotates in a second predetermined direction (e.g., a counter-clockwise direction), and causes the first mold portion 310 and the second mold portion 320 to close and form the mold cavity for a next ice making cycle.

Referring to FIG. 11, the ice maker 1001 further includes a fixing shaft 503, through which the second shell portion 220 is connected to the base 100. In some embodiments, the second shell portion 220 is connected to the fixing shaft 503, or the second shell portion 220 is directly and fixedly connected to the base 100. Referring to FIGS. 8 to 11, in the case where the first shell portion 210 adopts the rotational opening-closing movement, an extending direction of the connecting rod assembly 700 is substantially the same as the movement direction of the first shell portion 210. For example, the connecting rod assembly 700 is formed as an arc plate, an end of the connecting rod assembly 700 adjacent to the first shell portion 210 is connected to the first shell portion 210 (e.g., by a screw), and the other end of the connecting rod assembly 700 adjacent to the second shell portion 220 is connected to the second push rod 420, so that the second strut 420 is linked with the first shell portion 210 by the connecting rod assembly 700.

The foregoing descriptions are merely specific implementations of the present disclosure, but the protection scope of the present disclosure is not limited thereto. Changes or replacements that any person skilled in the art could conceive of within the technical scope of the present disclosure shall be included in the protection scope of the present disclosure. Therefore, the protection scope of the present disclosure shall be subject to the protection scope of the claims.

It will be appreciated by those skilled in the art that, the scope of disclosure involved in the present disclosure is not limited to technical solutions formed by particular combinations of the above technical features, but shall also encompass other technical solutions formed by any combination of the above technical features or equivalents thereof without departing from the concept of present disclosure, for example, technical solutions formed by replacing the above features with technical features with similar functions disclosed in some embodiments (but not limited thereto).

What is claimed is:

1. A refrigerator, comprising:

a refrigerator body defining an ice making compartment therein; and an ice maker disposed in the ice making compartment, and the ice maker including:

a mold shell having a mold cavity and a water inlet communicated to the mold cavity, and the mold shell including a first sub-mold shell and a second sub-mold shell; one of the first sub-mold shell and the second sub-mold shell being fixed, and another of the first sub-mold shell and the second sub-mold shell being movable; the first sub-mold shell and the second sub-mold shell being configured to be switchable between a separated state and a closed state;

a driving mechanism configured to drive the first sub-mold shell or the second sub-mold shell to switch between the separated state and the closed state;

a first push rod located on a side of the first sub-mold shell away from the second sub-mold shell;

a second push rod located on a side of the second sub-mold shell away from the first sub-mold shell; one of the first push rod and the second push rod being fixed, and another of the first push rod and the second push rod being movable; and a connecting rod assembly including a connecting rod; an end of the connecting rod being connected to the movable one of the first sub-mold shell and the second sub-mold shell, and another end of the connecting rod being connected to the movable one of the first push rod and the second push rod;

wherein the first sub-mold shell includes:

a first shell portion including a first through hole that is matched with the first push rod; and a first mold portion disposed in the first shell portion, and the first push rod being configured to pass through the first through hole to push against the first mold portion;

the second sub-mold shell includes:

a second shell portion including a second through hole that is matched with the second push rod; and a second mold portion disposed in the second shell portion, and the second push rod being configured to pass through the second through hole to push against the second mold portion;

wherein an end of the connecting rod is connected to the first sub-mold shell, and another end of the connecting rod is connected to the second push rod, so that the first sub-mold shell is linked with the second push rod; and wherein the end of the connecting rod is provided with a fixing hole, the connecting rod further includes a strip-shaped hole, and the connecting rod assembly further includes:

a first buckle portion located on at least one side of the first sub-mold shell in a movement direction and configured to be matched with the fixing hole, so that the first shell portion is connected to the connecting rod; and a second buckle portion located on the second sub-mold shell; the second buckle portion and the first buckle portion being located on a same side of the mold shell; the second buckle portion being passed through and installed in the strip-shaped hole, and the connecting rod being movable with respect to the second buckle portion.

2. The refrigerator according to claim 1, wherein the mold shell includes:

a shell body including an inner cavity; and a mold body disposed in the inner cavity, and the mold body including the water inlet, the shell body including an avoidance opening that encloses an outer circumference of the water inlet.

3. The refrigerator according to claim 2, wherein the shell body includes the first shell portion and the second shell portion that are opposite to each other; a side of the first shell portion facing toward the second shell portion is provided with a first inner cavity, and a side of the second shell portion facing toward the first shell portion is provided with a second inner cavity; in the closed state, the first shell portion and the second shell portion enclose the inner cavity;

the mold body includes the first mold portion and the second mold portion that are disposed opposite to each other; the first mold portion is connected to the first shell portion, and the second mold portion is connected to the second shell portion; in the closed state, the first mold portion and the second mold portion enclose the mold cavity.

4. The refrigerator according to claim 3, wherein the first mold portion is disposed in the first inner cavity, and the second mold portion is disposed in the second inner cavity;

a side of the first mold portion facing toward the second mold portion is provided with a first concave cavity, and a side of the second mold portion facing toward the first mold portion is provided with a second concave cavity; in the closed state, the first concave cavity and the second concave cavity enclose the mold cavity.

5. The refrigerator according to claim 3, wherein an edge of a first concave cavity of the first mold portion is provided with a first engaging portion, and an edge of a second concave cavity of the second mold portion is provided with a second engaging portion; the second engaging portion is configured to be matched with the first engaging portion.

6. The refrigerator according to claim 5, wherein one of the first engaging portion and the second engaging portion includes a convex rib, and another one of the first engaging portion and the second engaging portion includes a groove.

7. The refrigerator according to claim 3, wherein at least one of the first mold portion or the second mold portion is a silicone member.

8. The refrigerator according to claim 3, wherein a side of the first shell portion proximate to the second shell portion is provided with a first groove, and a side of the second shell portion proximate to the first shell portion is provided with a second groove; in the closed state, the first groove and the second groove are closed to form the avoidance opening.

9. The refrigerator according to claim 3, wherein the mold body includes a plurality of mold cavities, and at least one of the plurality of mold cavities includes the water inlet; a water tank is disposed above the shell body, and the water tank includes a water dispensing port corresponding to the water inlet.

10. The refrigerator according to claim 9, wherein a plurality of water holes in communication with each other are disposed between the plurality of mold cavities.

11. The refrigerator according to claim 3, wherein the water inlet satisfies at least one of the following:

the water inlet being formed as an annular shape;

the water inlet and the first mold portion being formed as a one-piece member; or, the water inlet and the second mold portion being formed as a one-piece member.

12. The refrigerator according to claim 1, wherein a side surface of the first push rod proximate to the first mold portion is configured to be matched with a contour surface of a first concave cavity of the first mold portion;

a side surface of the second push rod proximate to the second mold portion is configured to be matched with a contour surface of a second concave cavity of the second mold portion.

13. The refrigerator according to claim 1, wherein the driving mechanism includes:

a rotating shaft;

a motor connected to the rotating shaft to drive the rotating shaft to rotate;

a gear set, the gear set being connected to the rotating shaft;

a rack drivingly connected to the gear set, and the rack being connected to the first sub-mold shell or the second sub-mold shell; and a slide rod disposed in the first sub-mold shell or the second sub-mold shell, so as to move the first sub-mold shell or the second sub-mold shell along the slide rod.

14. The refrigerator according to claim 13, wherein the driving mechanism further satisfies at least one of:

the driving mechanism including two racks disposed on two sides of a top of the first sub-mold shell or a top of the second sub-mold shell in a movement direction; or, the driving mechanism including four slide rods disposed at four corners of the first sub-mold shell or four corners of the second sub-mold shell.

15. The refrigerator according to claim 1, wherein the ice maker further includes:

a base configured to be connected to the ice making compartment;

the base including an opening, the opening being located at a position of an upper side plate of the base corresponding to the water inlet, and an external water tube being connected to the water inlet by passing through the opening to inject water into the plurality of mold cavities.

* * * * *